US006000074A

United States Patent [19]

Glover

[11] Patent Number: 6,000,074

[45] Date of Patent: Dec. 14, 1999

[54] PORTABLE SHOWER STALL

[76] Inventor: Mark T. Glover, 3359 F.M. 2256, Mineral Wells, Tex. 76067

[21] Appl. No.: 09/175,852

[22] Filed: Oct. 20, 1998

[51] Int. Cl.[6] ..... A47K 3/22; A47K 3/23

[52] U.S. Cl. ..... 4/599; 4/602

[58] Field of Search ..... 4/599, 600, 602, 4/603, 596, 597

[56] References Cited

U.S. PATENT DOCUMENTS

| | | | |
|---|---|---|---|
| D. 244,135 | 4/1977 | Barks | D23/57 |
| D. 323,208 | 1/1992 | Gunther | D23/283 |
| D. 339,860 | 9/1993 | Hildebrand | D23/283 |
| D. 385,618 | 10/1997 | Weinacker, Jr. | D23/229 |
| 757,933 | 4/1904 | Linendoll et al. | 4/602 X |
| 1,960,969 | 5/1934 | Duncan | 4/154 |
| 2,561,265 | 7/1951 | Burns | 4/599 |
| 3,067,434 | 12/1962 | Neal et al. | 4/599 X |
| 3,391,409 | 7/1968 | Gatley | 4/599 X |
| 4,017,116 | 4/1977 | Hulsey | 296/26 |
| 4,413,363 | 11/1983 | Troiano | 4/599 |
| 4,457,553 | 7/1984 | Larkin | 4/602 X |
| 4,975,992 | 12/1990 | Patterson et al. | 4/599 |
| 5,544,369 | 8/1996 | Roberts | 4/599 |

*Primary Examiner*—Charles E. Phillips

*Attorney, Agent, or Firm*—John D. Gugliotta

[57] ABSTRACT

A portable shower stall is disclosed. The present invention is designed to utilize a conventional trailer receiving hitch by providing a portable bathing apparatus, otherwise similar in nature to those commonly suspended from overhanging objects, designed to be secured directly to a standard receiver hitch. A main frame, of a generally linearly elongated, rectangular, upstanding, L-shaped configuration slidably engage and fittingly secures inside of the square channel of a conventional receiver hitch typically found on a motor vehicle, such as a truck or camper, via a frictional fit. A trailer receiving hitch connecting means connects the present invention to the trailer hitch via locking means. A water container holding hook or similar device is located on the end of the vertical member, opposite the horizontal member. The water container holding hook is used to releasably secure a water container above the user's head. A valve is used to facilitate controlled release of the water from the water container. A circular, shower curtain supporting member, of a circular, wire-type configuration, is designed to slidably engage vertically along the vertical member while the circular, shower curtain supporting member remains positioned in a horizontal plane. Linear, vertical adjustment of the circular, shower curtain supporting member along the vertical member is accomplished via a vertical adjustment means. A shower curtain is slidably secured to the circular, shower curtain supporting member.

11 Claims, 5 Drawing Sheets

PORTABLE SHOWER STALL

RELATED APPLICATIONS AND DISCLOSURES

The present invention is a continuation of the Disclosure Document filed on Mar. 25, 1998. There are no previously filed, nor any copending applications anywhere in the world.

BACKGROUND OF THE INVENTION

1. Field of the Invention

The present invention relates generally to portable showering devices, and, more particularly, to portable shower stall.

2. Description of the Related Art

Camping, hunting and other outdoor activities continue to be among today's most popular leisure activities. The people who enjoy these activities possess a variety of devices that are intended to provide many of the conveniences that they have become accustomed to at home. Portable stoves, inflatable mattresses, and even portable generators that make available a variety of appliances are among the devices commonly found at campsites across the nation.

Many campgrounds are equipped with plumbing at centrally located community bathhouses so that people can obtain water for drinking and cooking purposes. However, in situations where people are camping in the truest sense of the term, i.e., out in the wilderness, or where a campground is not equipped with plumbing, they are forced to carry their own supply of water.

In these situations, many people make use of portable, solar heated shower devices in which a clear bag, filled with water and having a shower nozzle attached thereto, is suspended from a tree or other overhanging object.

This type of device usually includes a curtain that surrounds the user, forming a shower stall, allowing him or her to bathe privately therein.

In the previous art, numerous devices are disclosed to assist in outdoor showering. U.S. Pat. No. 4,017,116, issued in the name of Hulsey describes a collapsible shower stall inside the camper.

Several patents describe collapsible, portable, and lightweight shower stalls. These include U.S. Pat. No. 5,544,369, issued in the name of Roberts, U.S. Pat. No. 4,975,992 issued in the name of Patterson et. al., U.S. Pat. No. 4,413,363 issued in the name of Troiano, U.S. Pat. No. D 339,860 issued in the name of Hildebrand, U.S. Pat. No. D 323,208 issued in the name of Güinther and U.S. Pat. No. D 244,135 issued in the name of Banks U.S. Pat. No. 1,960, 969 issued in the name of Duncan discloses a collapsible shower curtain bracket and attachment for the stall.

U.S. Pat. No. D 385,618 issued in the name of Weinacker, describes the ornamental design of a portable shower head.

While these devices may be effective in providing a means by which to bathe where there is no modern plumbing, they do suffer from one or more of the following drawbacks. First, the devices are often burdensome, inconvenient and even dangerous to secure to the overhanging structure, such as a tree. Second, a tree with a sufficiently sturdy and configured branches may not be near the camp site, thus necessitating long walks from the camp site to shower. Third, the device is difficult to quickly pack and unpack. Fourth, the device cannot be easily stored in a small volume when not in use. Fifth, the device is difficult to assemble.

Accordingly, there is a need for a solid, structurally stable showering apparatus for providing a means by which one can bathe in a safe, convenient, manner in situations where there are no modern showering apparatuses and where there are no overhanging structures to utilize.

Many, if not most, campers drive vehicles such as pickup trucks, sports utility vehicles or automobiles that are equipped with a standard receiver hitch, consisting of a square channel into which a variety of different ball-type or other hitch attachments can be inserted and secured.

A search of the prior art did not disclose any patents that read directly on the claims of the instant invention. Consequently, a need has been felt for providing an apparatus and method which overcomes the problems cited above by utilizing a standard trailer receiving hitch to secure and support the showering device.

SUMMARY OF THE INVENTION

It is therefore an object of the present invention to provide an improved portable shower stall that provides a solid, structurally stable showering means by which one can bathe in a safe, convenient, manner in situations where there are no modern showering apparatuses and where there are no overhanging structures to utilize.

Briefly described according to one embodiment of the present invention, a portable shower stall is disclosed. The present invention utilizes a conventional trailer receiving hitch by providing a portable bathing apparatus, suspended from overhanging objects, that is designed to be secured directly to a standard receiver hitch.

The present invention discloses a main frame, of a generally linearly elongated, rectangular, upstanding, L-shaped configuration. In the preferred embodiment, the main frame is constructed of metal.

The main frame is designed to slidably engage and fittingly secure inside of the square channel of a conventional receiver hitch typically found on a motor vehicle, such as a truck or camper, via a frictional fit. The horizontal member of the main frame is of sufficient length to permit the longer, vertical member to extend upward vertically without coming into mechanical interference with the motor vehicle.

The horizontal member is secured to the receiving hitch via locking means, such as a locking pin.

When connected to the receiving hitch, the vertical member extends upward vertically a sufficient distance to facilitate the showering process, or at least seven feet above the ground.

A water container holding hook is located on the end of the vertical member, opposite the horizontal member. The water container holding hook is used to releasable secure a water container above the user's head.

The water container is capable of holding sufficient water to facilitate a typical shower. A shower head is connected to the lower portion of the water container when in use. A valve is used to facilitate controlled release of the water from the water container.

A circular, shower curtain supporting member, of a circular, wire-type configuration, is designed to slidably engage upward and downward along the vertical member while the circular, shower curtain supporting member remains positioned in the horizontal plane.

Vertical adjustment of the circular, shower curtain supporting member along the vertical member is accomplished via a vertical adjustment means. In the preferred embodiment of the present invention, the vertical adjustment means consists of an adjustment protrusion, extending outward radially from the circular, shower curtain supporting member, in the same plane as the circular, shower curtain supporting member.

A square hole is located in the adjustment protrusion. The hole shares the same vector of a radial centerline as the circular, shower curtain supporting member. The weight of the circular, shower curtain supporting member provides the lateral frictional force required to secure the circular, shower curtain supporting member to the vertical member, via a friction fit, when both components are in the static position. The square nature of the hole and the vertical member reduces rotation of the circular, shower curtain supporting member about the vertical member.

A shower curtain is secured to the circular, shower curtain supporting member, said shower curtain being capable of lateral movement along the circular, shower curtain supporting member.

When installed, the main frame provides a sturdy foundation from which to hang the shower curtain and the water container.

It is envisioned that the vertical member and circular, shower curtain supporting member are of a multi-piece construction, secured together via a frictional fit, so as to facilitate rapid assembly and disassembly and storage.

It is another object of the present invention to provide a device that eliminates the need to find an overhead structure to support the device.

It is another object of the present invention to provide a device of a strong, durable construction.

It is another object of the present invention to provide a device that is easy to manufacture in a low cost manner.

DESCRIPTIVE KEY

| | | | |
|---|---|---|---|
| 10 | portable shower stall | 90 | water container |
| 15 | receiving hitch | 100 | shower head |
| 20 | main frame | 110 | valve |
| 30 | square channel | 120 | circular, shower curtain supporting member |
| 50 | motor vehicle | 130 | vertical adjustment means |
| 55 | trailer receiving hitch connecting means | 140 | adjustment protrusion |
| 60 | horizontal member | 150 | hole |
| 70 | vertical member | 160 | shower curtain |
| 75 | locking means | | |
| 80 | water container holding hook | | |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 6.

1. Detailed Description of the Figures

Figure 1:
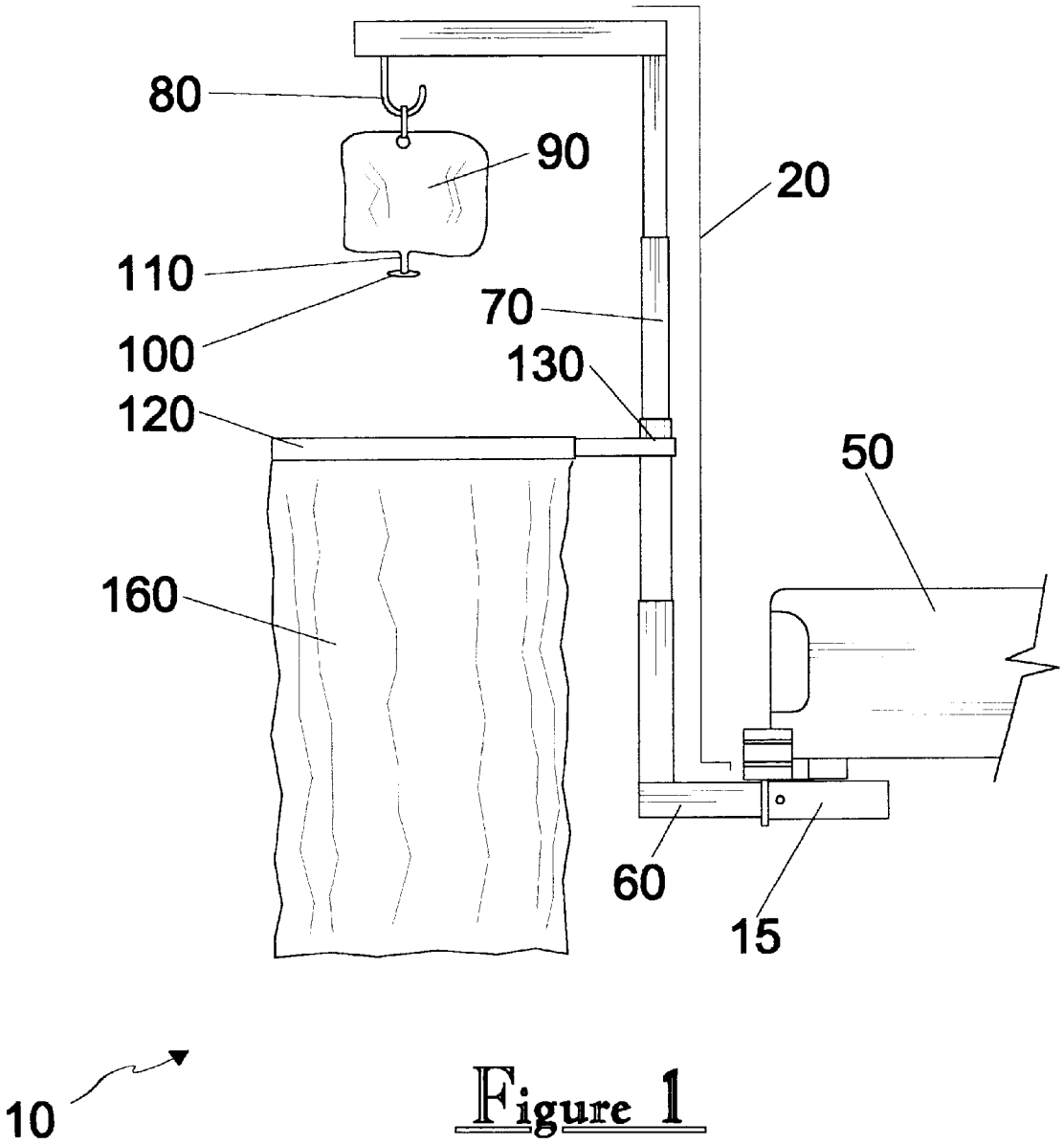
FIG. 1 is a perspective view of the preferred embodiment of portable shower stall 10.

Referring now to FIG. 1, a portable, trailer receiving hitch 15 connecting, shower stall 10 is shown, according to the present invention, utilizing a conventional trailer receiving hitch 15 for providing a portable bathing apparatus that is designed to be secured directly to a standard receiver hitch 15.

Figure 2:
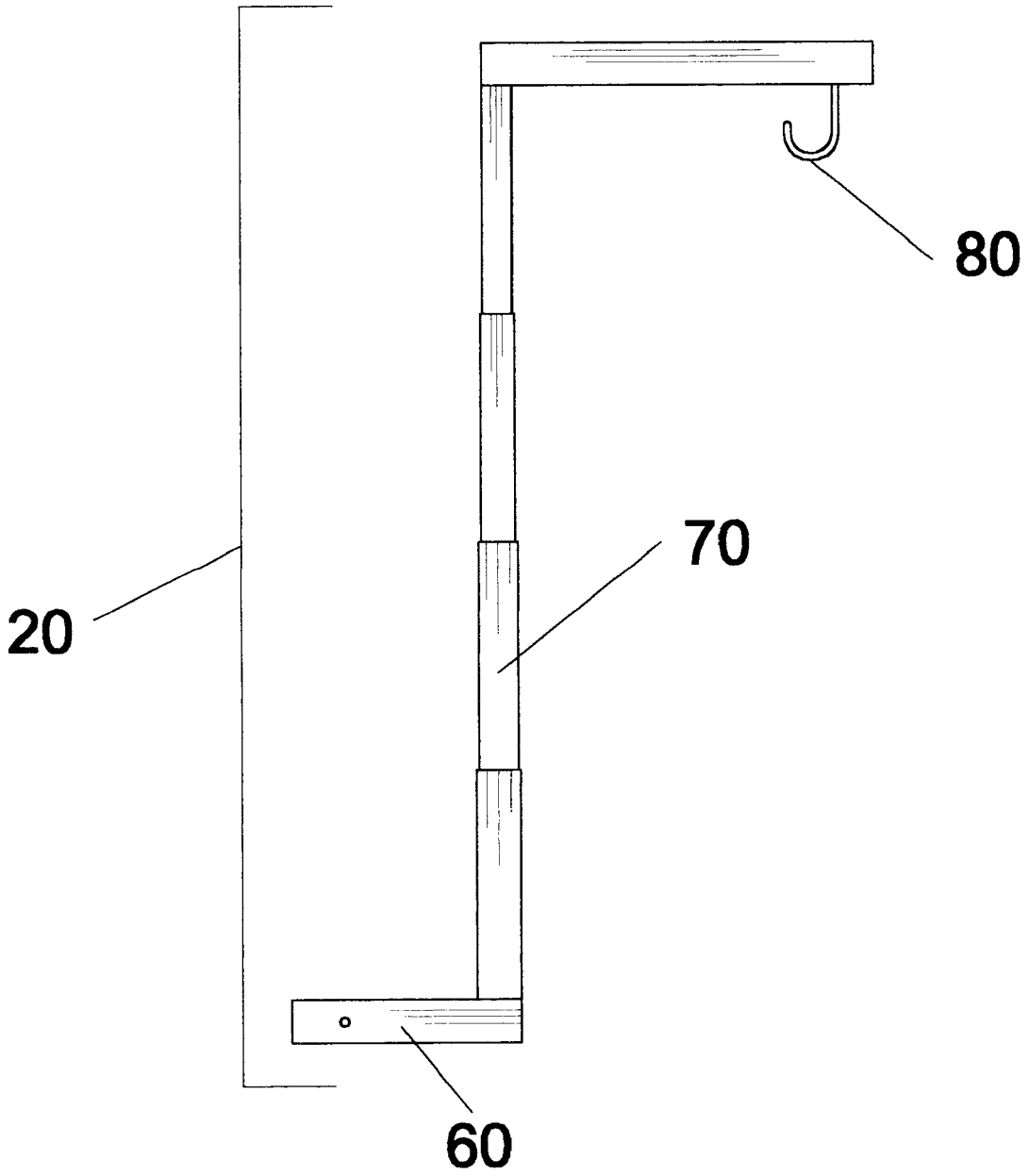
FIG. 2 is a side view of the main frame.
Figure 3A:
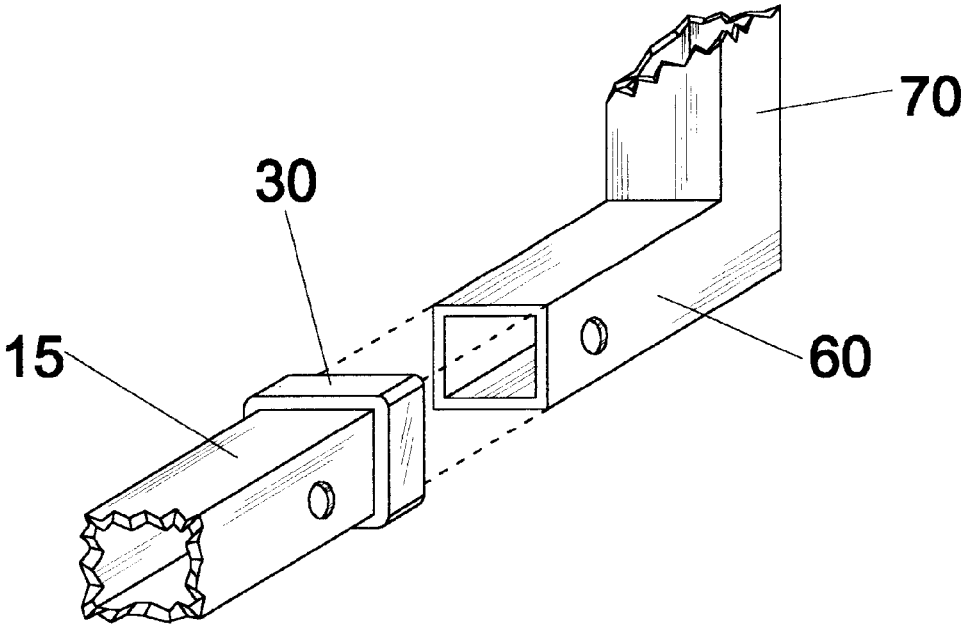
FIG. 3*a* is an enlarged, exploded view of the horizontal member of the main frame attaching to a conventional trailer receiving hitch.
Figure 3B:
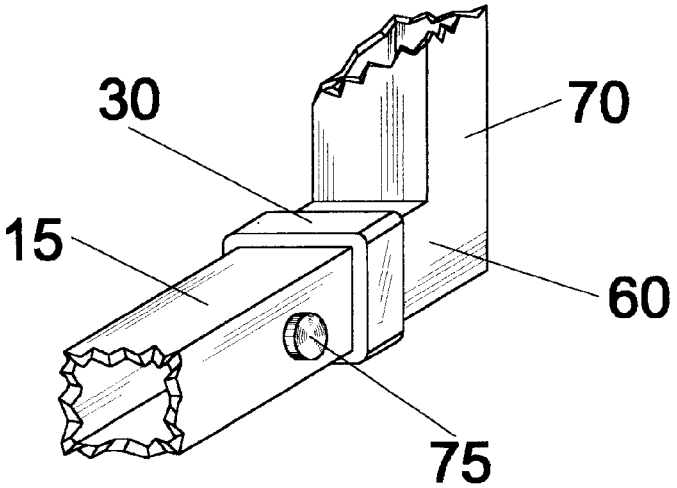
FIG. 3*b,* is an enlarged view of the connection of the main frame to the receiving hitch via the locking means.

Referring now to FIGS. 1 and 2, the present invention discloses a main frame 20, of a generally linearly elongated, rectangular, upstanding, L-shaped configuration. In the preferred embodiment, the main frame 20 is constructed of material in order to provide sufficient structural rigidity in an economical manner selected from the group comprising metal.

Referring now to FIGS. 1, 2, 3*a* and 3*b,* the main frame 20 slidably engages and fittingly secures inside of the square channel 30 of a conventional receiver hitch 15 of the style typically found on a motor vehicle 50, such as a truck or camper via a trailer receiving hitch connecting means 55, located on the end of the horizontal member 60, opposite the vertical member 70. The present disclosure anticipates this securement via a frictional fit. The horizontal member 60 of the main frame 20 is of sufficient length to permit a longer, vertical member 70 to extend upward vertically without coming into mechanical interference with the motor vehicle 50.

The trailer receiving hitch connecting means 55 is secured to the receiving hitch 15 via locking means 75, herein shown as a locking pin.

When the trailer receiving hitch connecting means 55 is connected to the receiving hitch 15, the vertical member 70 extends upward vertically a sufficient distance to facilitate the showering process. A water container holding hook 80 is located on the end of the vertical member 70, opposite the horizontal member 60. The water container holding hook 80 is used to releasable secure a water container 90 above the user's head.

The water container 90 is capable of holding sufficient water to facilitate a typical shower. A shower head 100 is connected to the lower portion of the water container 90 when in use. A valve 110 is used to facilitate controlled release of the water from the water container 90.

Figure 4:
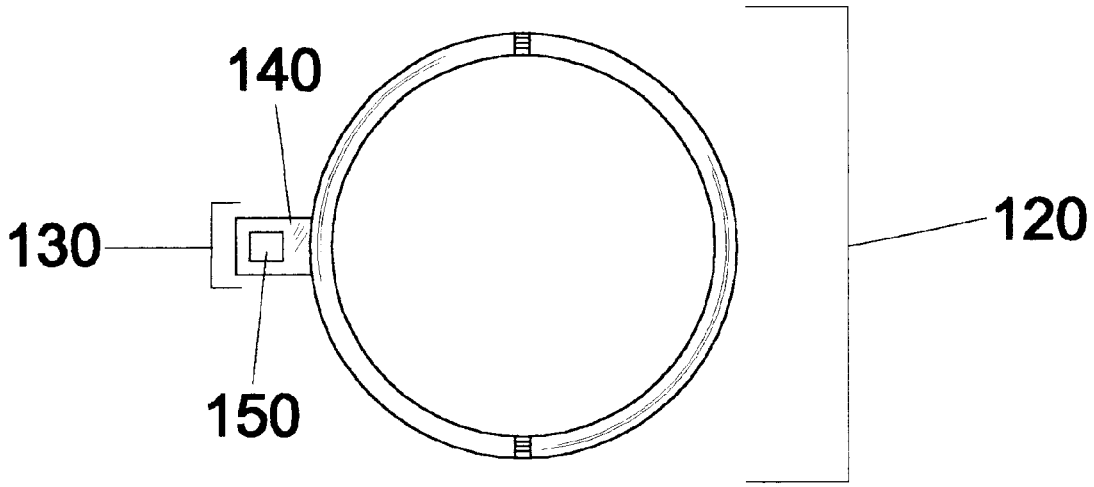
FIG. 4 is a top view of the circular, shower curtain supporting member.

Referring now to FIGS. 1 and 4, a circular, shower curtain supporting member 120, of a circular, wire-type configuration, slidably engages upward and downward along the vertical member 70 while the circular, shower curtain supporting member 120 remains positioned in the horizontal plane. Vertical adjustment of the circular, shower curtain supporting member 120 linearly along the vertical member 70 is accomplished via vertical adjustment means 130. In the preferred embodiment of the present invention, the vertical adjustment means 130 consists of an adjustment protrusion 140, extending outward radially from the circular, shower curtain supporting member 120, in the same plane as the circular, shower curtain supporting member 120.

Figure 5:
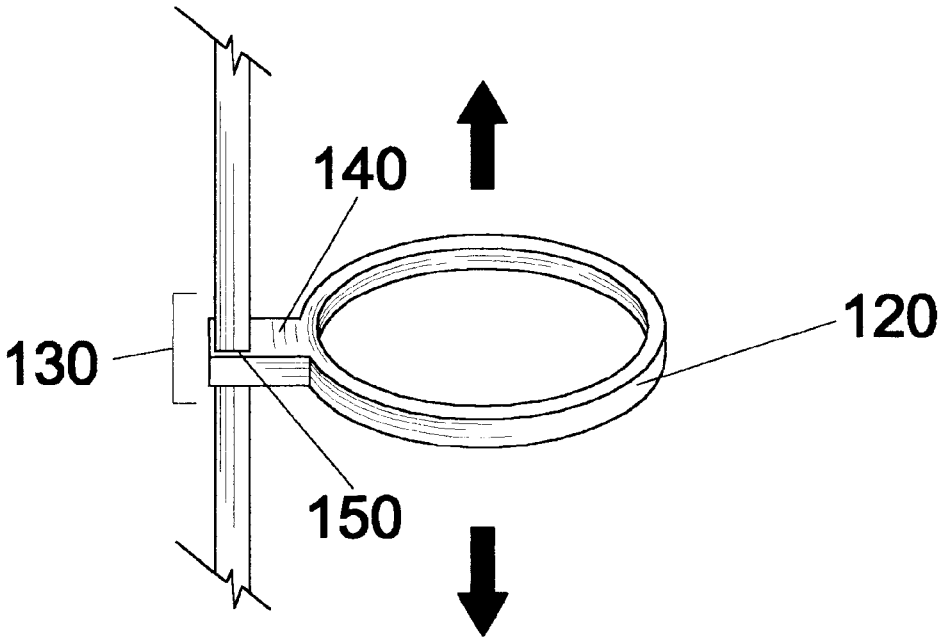
FIG. 5 is a perspective view of the circular, shower curtain supporting member, showing its vertical adjustment capabilities.

Referring now to FIGS. 4 and 5, a square hole 150 is located in and formed by the adjustment protrusion 140. The hole 150 shares the same vector of radial centerline as the circular, shower curtain supporting member 120. The weight of the circular, shower curtain supporting member 120 provides the frictional resistance to vertical force required to secure the circular, shower curtain supporting member 120 to the vertical member 70. The square nature of both the hole 150 and the vertical member 70 reduces rotation of the circular, shower curtain supporting member 120 about the vertical member 70.

Figure 6:
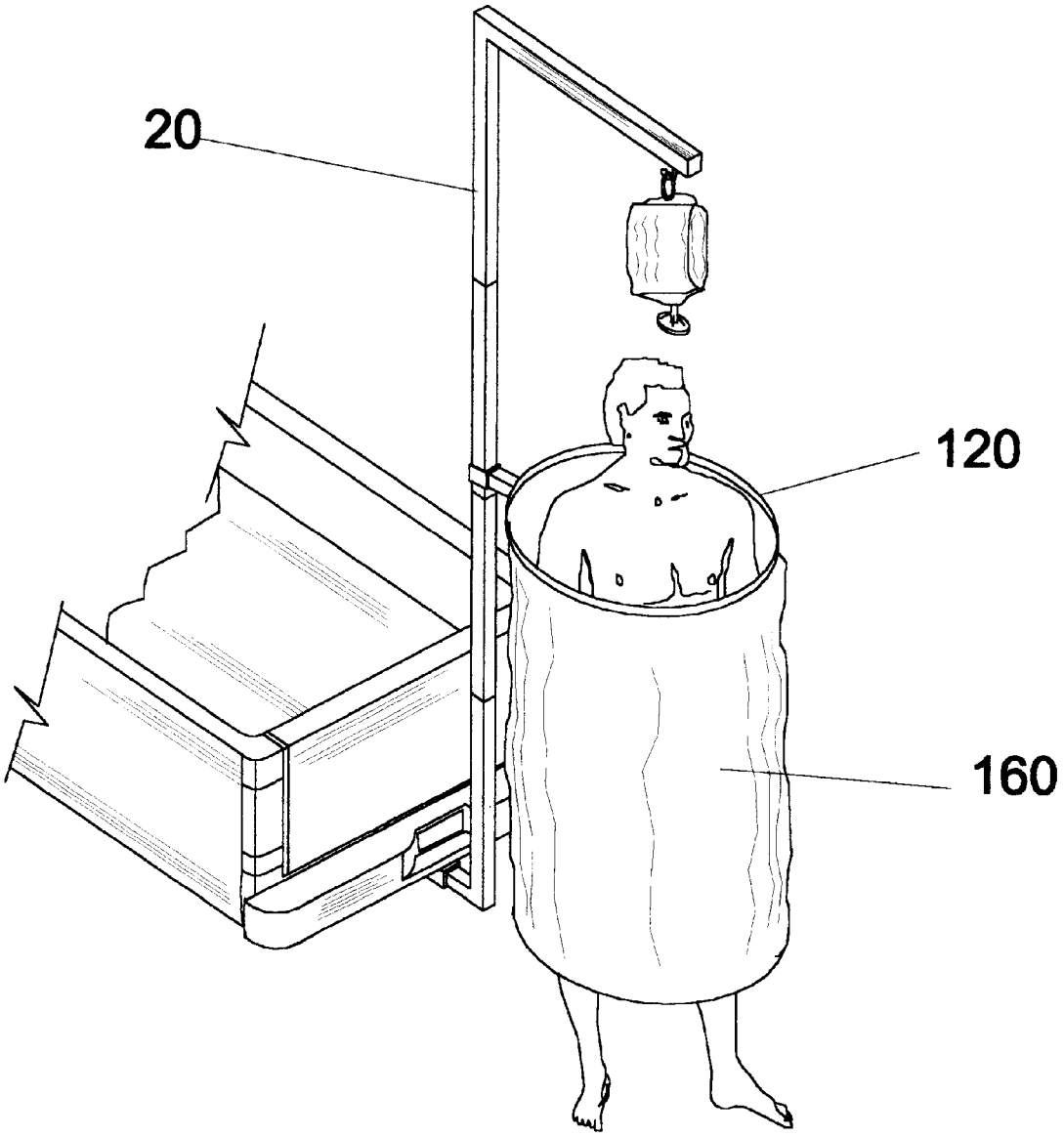
FIG. 6 is an in-use view of the preferred embodiment of the present invention.

Referring now to FIGS. 1 and 6, a shower curtain 160 is secured to the circular, shower curtain supporting member 120, in a manner such that said shower curtain 160 is capable of lateral movement along the circumferential tract formed by said circular, shower curtain supporting member 120. Also, it is envisioned that the shower curtain 160 may have numerous patterns on its exterior surface, such as camaflouge.

When installed, the main frame 20 provides a sturdy foundation from which to hang the shower curtain 160 and the water container 90. It is envisioned that the vertical member 70 and circular, shower curtain supporting member 120 are of multi-piece construction, secured together via a frictional fit, so as to facilitate rapid assembly and disassembly and storage. However, it is also envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

Referring now to FIGS. 1–6, to use the present invention: a user first assembles the vertical member 70 and circular, shower curtain supporting member 120. The horizontal member 60 is inserted into the trailer receiving hitch 15, and secured with the locking means. The circular, shower curtain supporting member 120 is placed over the vertical member 70, and the shower curtain connected thereto. If required, the height of the circular, shower curtain supporting member 120 is adjusted prior to securing the water container 90 upon the water container holding hook 80. Upon releasing the valve 110 on the water container 90, the user can shower in a traditional manner. When done, the device is disassembled for easy storage.

The foregoing description is included to illustrate the operation of the preferred embodiment and is not meant to limit the scope of the invention. The scope of the invention is to be limited only by the following claims.

What is claimed is:

1. A portable shower stall comprising:

a main frame, said main frame of a generally linearly elongated, rectangular, upstanding, L-shaped configuration, forming a vertical member and a horizontal member; said main frame further designed to slidably engage and fittingly secure inside of the square channel of a conventional receiver hitch typically found on a motor vehicle, such as a truck or camper, via a frictional fit;

locking means, said locking means for securing said horizontal member to said receiving hitch;

a water container;

a water container holding hook, located on an end of said vertical member, opposite said horizontal member, said water container holding hook used to releasably secure said water container;

a circular, shower curtain supporting member, of a circular, wire-type configuration, said circular, shower curtain supporting member designed to slidably engage linearly along said vertical member while said circular, shower curtain supporting member remains positioned in a horizontal plane;

vertical adjustment means, said vertical adjustment means used to adjust and lock said circular, shower curtain supporting member at a variety of positions linearly along said vertical member; and a shower curtain, said shower curtain slidably secured to said circular, shower curtain supporting member such that lateral movement along said circular, shower curtain supporting member is provided.

2. The shower stall described in claim 1, wherein said vertical adjustment means further comprises:

an adjustment protrusion, said adjustment protrusion extending outward radially from said circular, shower curtain supporting member, in the same plane as said circular, shower curtain supporting member; and a square hole, formed by said adjustment protrusion, said hole sharing the same vector of radial centerline as said circular, shower curtain supporting member.

3. The vertical adjustment means described in claim 2, wherein the weight of said circular, shower curtain supporting member provides the lateral frictional force required to secure said circular, shower curtain supporting member to said vertical member, via a friction fit.

4. The shower stall described in claim 1, wherein said horizontal member of said main frame is of sufficient length to permit the longer, vertical member to extend upward vertically without coming into mechanical interference with said motor vehicle.

5. The shower stall described in claim 1, wherein said main frame is constructed of metal.

6. The shower stall described in claim 1, wherein said main frame is designed to slidably engage and fittingly secure inside of said square channel of a conventional receiver hitch typically found on a motor vehicle, via a frictional fit.

7. The shower stall described in claim 1, wherein said vertical adjustment means, said vertical adjustment means used to adjust and lock said circular, shower curtain supporting member at a variety of positions linearly along said vertical member.

8. The shower stall described in claim 1, wherein when connected to said receiving hitch, said vertical member extends upward vertically a sufficient distance to facilitate the showering process.

9. The shower stall described in claim 1, wherein said vertical member is of a multi-piece construction, secured together via a frictional fit, so as to facilitate rapid assembly and disassembly and storage.

10. The shower stall described in claim 1, wherein said circular, shower curtain supporting member are of a multi-piece construction, secured together via a frictional fit, so as to facilitate rapid assembly and disassembly and storage.

11. The shower stall described in claim 1, wherein said circular, shower curtain supporting member designed to slidably engage linearly along said vertical member while said circular, shower curtain supporting member remains positioned in a horizontal plane.

* * * * *